US005960234A

United States Patent [19]

Shibaki et al.

[11] Patent Number: 5,960,234

[45] Date of Patent: Sep. 28, 1999

[54] TIME DISTANCE DISPLAY APPARATUS FOR IMAGE FORMING APPARATUS

[75] Inventors: Seiji Shibaki, Toride; Mitsuo Nimura, Kashiwa, both of Japan

[73] Assignee: Canon Kabushiki Kaisha, Tokyo, Japan

[21] Appl. No.: 08/995,909

[22] Filed: Dec. 22, 1997

[30] Foreign Application Priority Data

Dec. 27, 1996 [JP] Japan ..... 8-351560
Dec. 27, 1996 [JP] Japan ..... 8-351562

[51] Int. Cl.[6] ..... G03G 15/00; G03G 21/14

[52] U.S. Cl. ..... 399/75; 399/76; 399/81; 399/82; 399/83

[58] Field of Search ..... 399/43, 81, 85, 399/411, 16, 17, 76, 361, 363, 77, 394, 396, 82, 83, 75; 395/114, 115, 116, 117, 561

[56] References Cited

U.S. PATENT DOCUMENTS 3,944,360 3/1976 Deetz et al. ..... 355/14
4,511,243 4/1985 Smith .
4,816,864 3/1989 Tanaka et al. ..... 355/14
5,036,361 7/1991 Filion et al. .
5,309,557 5/1994 Saitoh et al. ..... 395/162
5,809,371 10/1998 Inui et al. ..... 399/81

FOREIGN PATENT DOCUMENTS 0714058 5/1996 European Pat. Off. ..... G06F 15/00

*Primary Examiner*—Richard Moses
*Assistant Examiner*—Shival Virmani
*Attorney, Agent, or Firm*—Fitzpatrick, Cella, Harper & Scinto

[57] ABSTRACT

A time distance notifying system for an image forming apparatus sets an image forming mode composed of one or plural image forming parameters, generates attribute data to discriminate the set image forming mode, stores time data representing a time required for forming an image in the image forming mode represented by various attribute data, measures a time required for performing an operation of a predetermined unit during the set image forming mode, judges whether or not time corresponding to the generated attribute data has been stored in the memory, derives a time required for the image forming on the basis of a corresponding time data in a case where it is judged that a time data corresponding to the attribute data has been stored and for deriving a time required for the image forming on the basis of a time measured in a case where it is judged that a time data corresponding to the attribute data is not stored in a memory, and notifying a time derived.

28 Claims, 6 Drawing Sheets

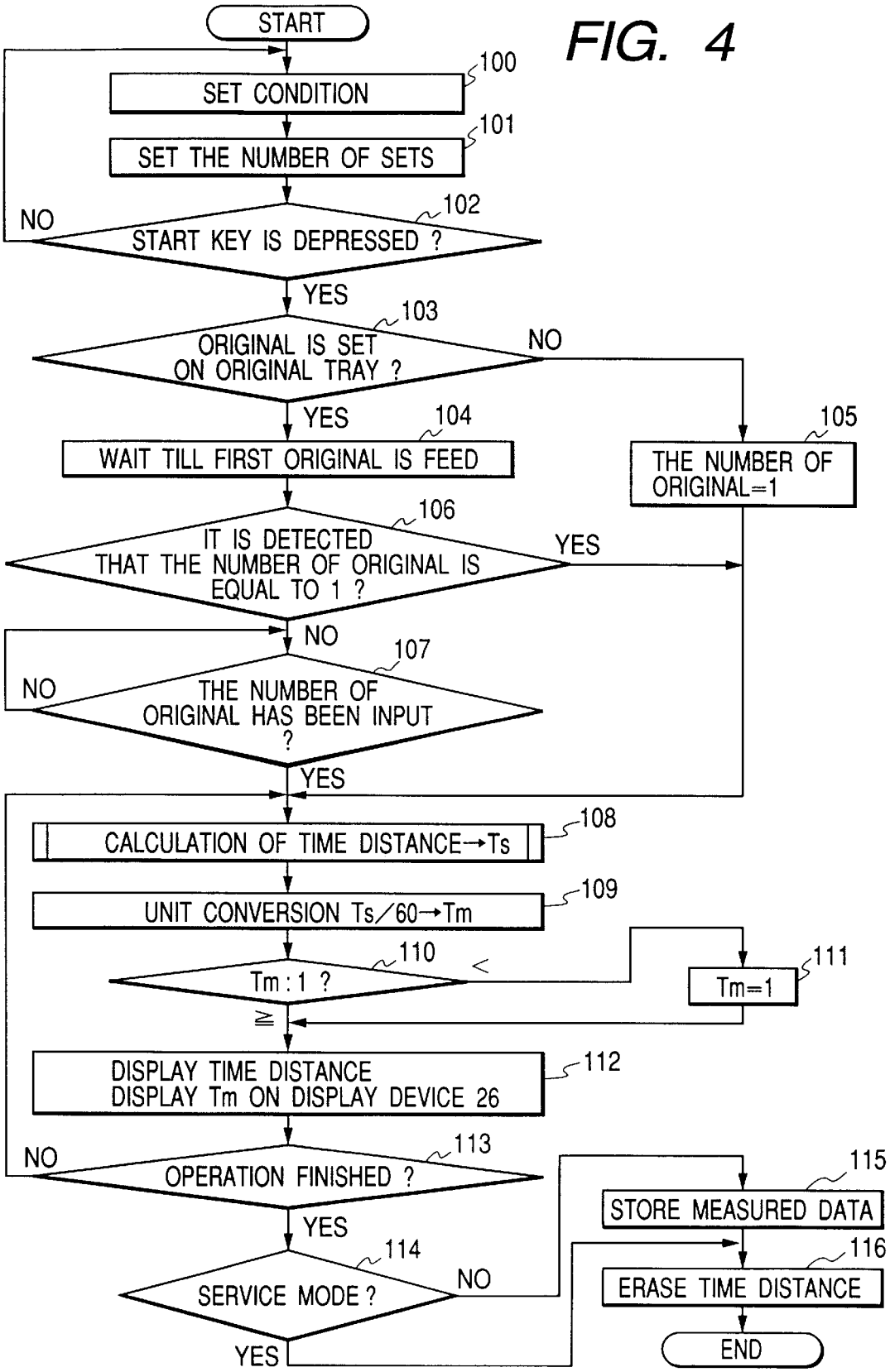
FIG. 4
START
SET CONDITION
100
SET THE NUMBER OF SETS
101
START KEY IS DEPRESSED ?
102
NO
YES
ORIGINAL IS SET ON ORIGINAL TRAY ?
103
NO
YES
WAIT TILL FIRST ORIGINAL IS FEED
104
THE NUMBER OF ORIGINAL=1
105
IT IS DETECTED THAT THE NUMBER OF ORIGINAL IS EQUAL TO 1 ?
106
YES
NO
THE NUMBER OF ORIGINAL HAS BEEN INPUT ?
107
NO
YES
CALCULATION OF TIME DISTANCE→Ts
108
UNIT CONVERSION Ts/60→Tm
109
Tm : 1 ?
110
<
Tm=1
111
≧
DISPLAY TIME DISTANCE
DISPLAY Tm ON DISPLAY DEVICE 26
112
OPERATION FINISHED ?
113
NO
YES
SERVICE MODE ?
114
NO
YES
STORE MEASURED DATA
115
ERASE TIME DISTANCE
116
END

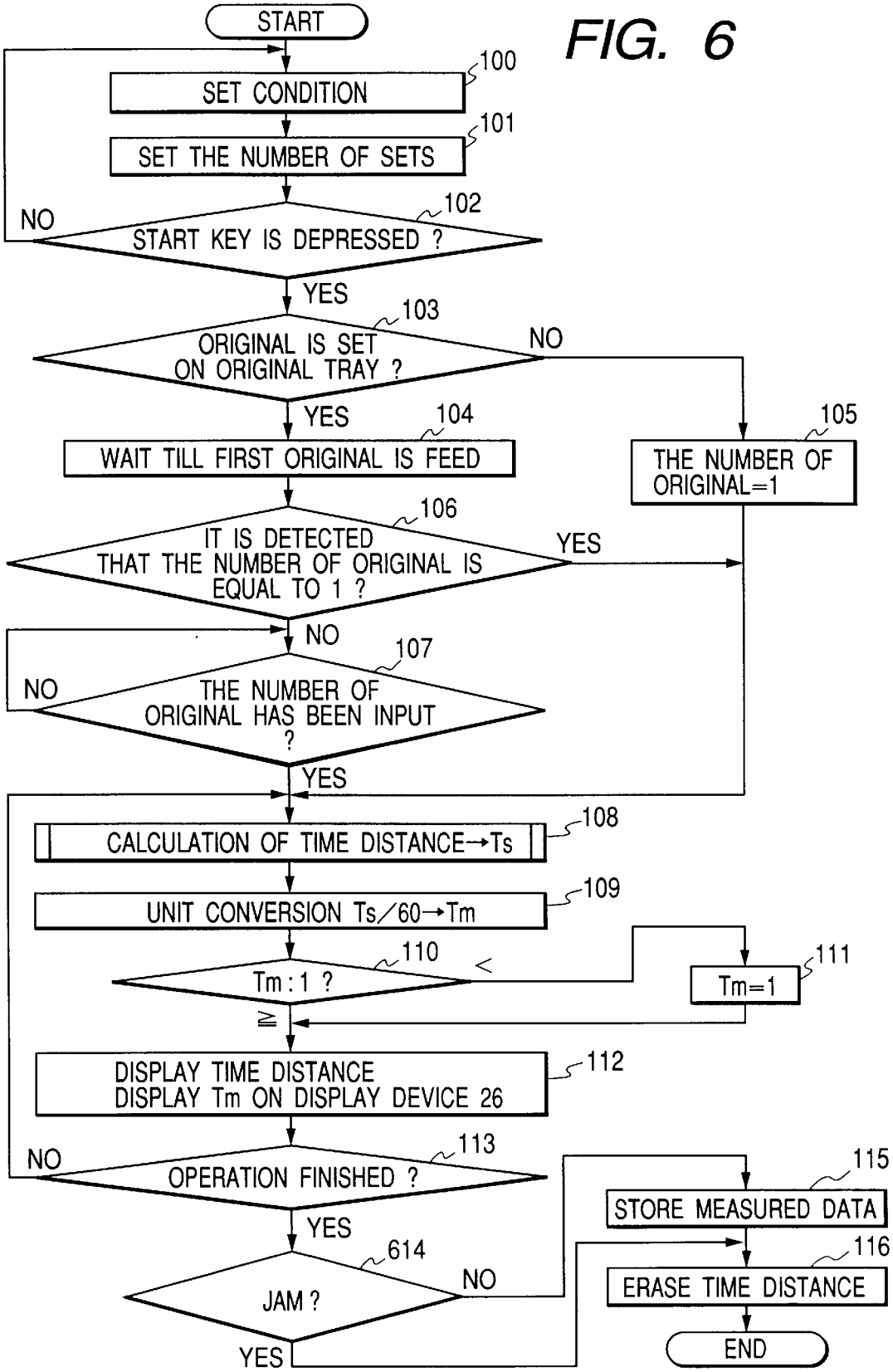
FIG. 6
START
SET CONDITION
100
SET THE NUMBER OF SETS
101
START KEY IS DEPRESSED ?
102
NO
YES
ORIGINAL IS SET ON ORIGINAL TRAY ?
103
NO
YES
WAIT TILL FIRST ORIGINAL IS FEED
104
THE NUMBER OF ORIGINAL=1
105
IT IS DETECTED THAT THE NUMBER OF ORIGINAL IS EQUAL TO 1 ?
106
YES
NO
THE NUMBER OF ORIGINAL HAS BEEN INPUT ?
107
NO
YES
CALCULATION OF TIME DISTANCE→Ts
108
UNIT CONVERSION Ts/60→Tm
109
Tm : 1 ?
110
<
Tm=1
111
≧
DISPLAY TIME DISTANCE
DISPLAY Tm ON DISPLAY DEVICE 26
112
OPERATION FINISHED ?
113
NO
YES
JAM ?
614
NO
YES
STORE MEASURED DATA
115
ERASE TIME DISTANCE
116
END

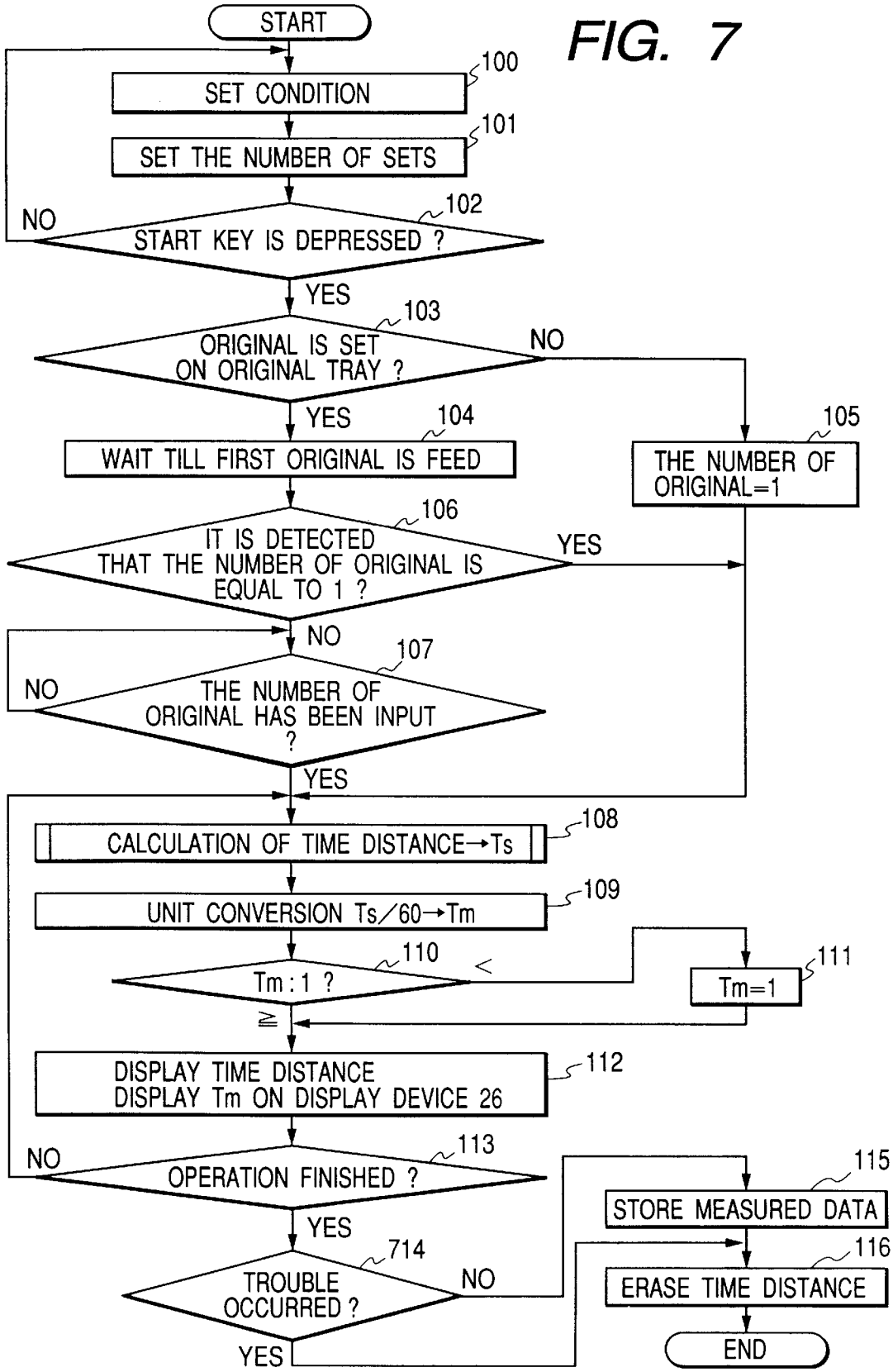
FIG. 7
START
SET CONDITION
100
SET THE NUMBER OF SETS
101
START KEY IS DEPRESSED ?
102
NO
YES
ORIGINAL IS SET ON ORIGINAL TRAY ?
103
NO
YES
WAIT TILL FIRST ORIGINAL IS FEED
104
THE NUMBER OF ORIGINAL=1
105
IT IS DETECTED THAT THE NUMBER OF ORIGINAL IS EQUAL TO 1 ?
106
YES
NO
THE NUMBER OF ORIGINAL HAS BEEN INPUT ?
107
NO
YES
CALCULATION OF TIME DISTANCE→Ts
108
UNIT CONVERSION Ts/60→Tm
109
Tm : 1 ?
110
<
Tm=1
111
≧
DISPLAY TIME DISTANCE DISPLAY Tm ON DISPLAY DEVICE 26
112
OPERATION FINISHED ?
113
NO
YES
TROUBLE OCCURRED ?
714
NO
YES
STORE MEASURED DATA
115
ERASE TIME DISTANCE
116
END

TIME DISTANCE DISPLAY APPARATUS FOR IMAGE FORMING APPARATUS

BACKGROUND OF THE INVENTION

1. Field of the Invention

The present invention relates to an apparatus for displaying a time distance until necessary images are formed.

2. Related Background Art

Image forming apparatuses such as copiers and printers are under development in which a time distance from the start to end of image forming operation is displayed on a display device which also displays a set image forming mode (paper size, the number of copies to be formed, magnification factor and the like). A function of predicting a time distance from the start to end of image forming operation in accordance with a set image forming mode and displaying the predicted time distance on the display device to inform a user of it, is now taken into consideration. For example, a message such as "take 3 minutes to end", "wait time is 3 minutes" and "predicted end time 11:20" is displayed. Another consideration is to display the state of image forming operation. For example, messages such as "take 2 minutes to end" and "take 1 minute to end" are sequentially displayed after a message "take 3 minutes to end" is first displayed.

In order to realize such a display function, it is considered to prestore time distances in various image forming modes and in accordance with this stored data, predict and display a total time distance required for the designated image forming mode.

Instead of prestoring various data in a memory, the total time distance may be predicted through calculation after measuring a scan interval for reading originals after the image forming operation is actually started.

Even if various data is prestored in a memory, the necessary time distance cannot be calculated if the memory does not store the data corresponding to an image forming mode designated by a user. With the method of performing a predictive calculation from the measurement of a scan interval for reading originals after the image forming operation is actually started, however, the total time distance cannot be calculated until the measurement is finished.

In order to calculate the time distances for all image forming modes, time data for all attribute data (parameter data of settable image forming modes) is required to be prestored so that the memory capacity becomes large. If time data for some of attribute data is prestored, the use frequency of prestored time data may become low because frequently used image forming modes are different from one user to another user. The frequency of predictive calculations becomes therefore low.

Even if a plurality of attribute data sets are stored in a memory, only one set is used so that the memory capacity is used wastefully. If the memory stores a number of same attribute data sets, the number of types of attribute data sets becomes small so that the capability of predictive calculations may become low. In this case, the measurement (e.g., measurement of scan interval) is required after the actual image forming operation starts so that the calculation time is prolonged.

SUMMARY OF THE INVENTION

It is an object of the present invention to provide a time distance display apparatus and a time distance display method capable of solving the above problems.

It is another object of the present invention to provide a time distance display apparatus and a time distance display method capable of quickly and correctly informing a time required for image forming.

It is another object of the present invention to provide a time distance display apparatus and a time distance display method capable of displaying a time required for image forming in each of various image forming modes, while reducing the use amount of a memory.

It is another object of the present invention to provide a time distance display apparatus and a time distance display method capable of improving a prediction precision of a time distance by storing a time distance data measured during image forming, as learning data to be later used.

It is another object of the present invention to provide a time distance display apparatus and a time distance display method capable of preventing an increase of prediction errors of a time distance by removing the time distance required for image forming in a service mode or during a jam, from the learning data.

Other objects of the present invention will become apparent from the following description and appended claims when read in conjunction with the accompanying drawings.

BRIEF DESCRIPTION OF THE DRAWINGS

FIG. 4 is a flow chart illustrating a time distance display control process.

FIG. 6 is a flow chart illustrating a time distance display control process according to a second embodiment of the invention.

FIG. 7 is a flow chart illustrating a time distance display control process according to a third embodiment of the invention.

DETAILED DESCRIPTION OF THE PREFERRED EMBODIMENTS

An embodiment of the image forming apparatus applied to the invention will be described with reference to the accompanying drawings.

Figure 1:
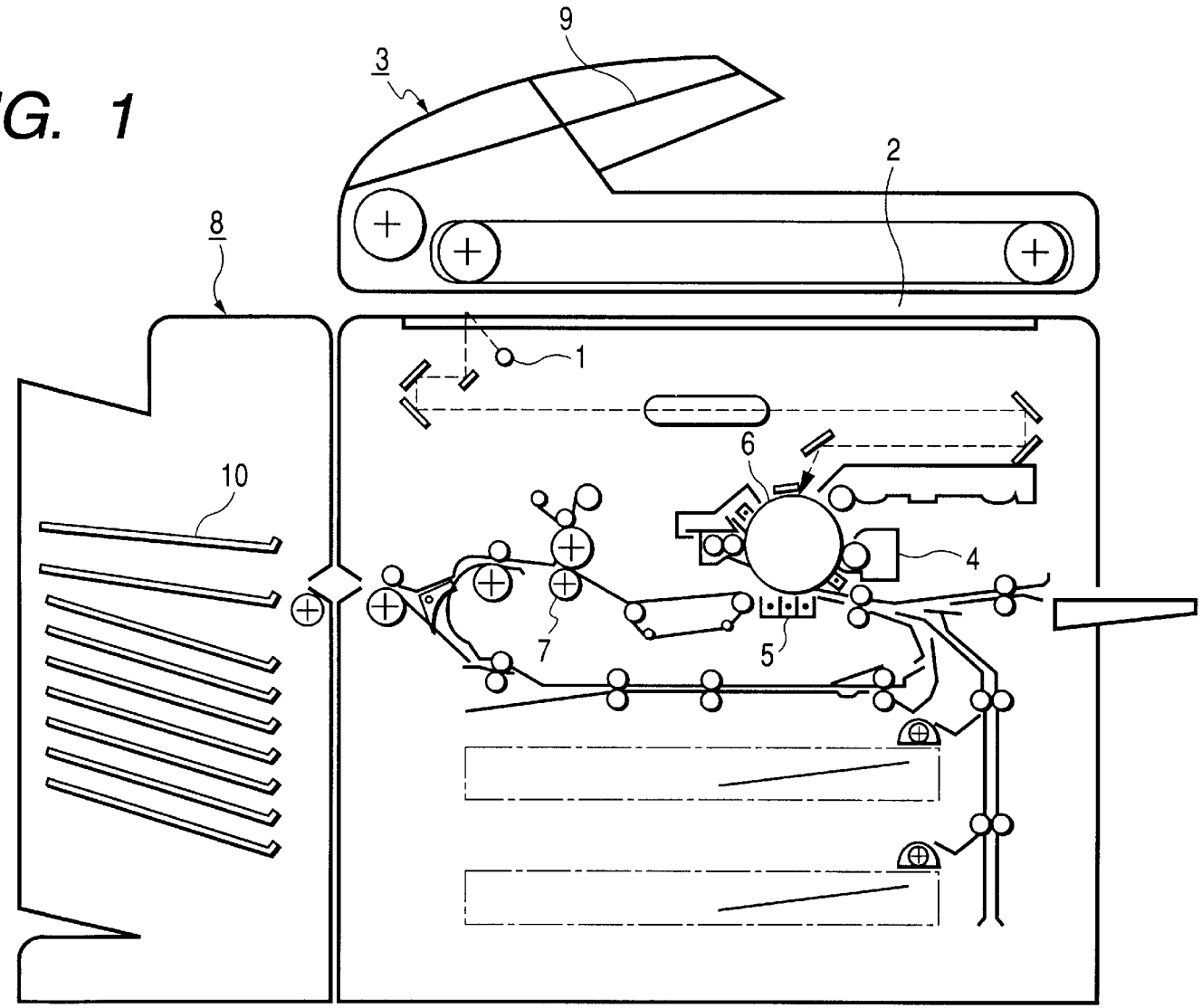
FIG. 1 is a cross sectional view showing an image forming apparatus to which the present invention is applied.

FIG. 1 is a schematic diagram showing the internal structure of an image forming apparatus applied to the invention. In FIG. 1, reference numeral 1 represents an original illuminating lamp, reference numeral 2 represents an original placing glass plate, reference numeral 3 represents an automatic original feeder, reference numeral 4 represents a developing unit, reference numeral 5 represents a transfer/separation charger, reference numeral 6 represents a photosensitive drum, reference numeral 7 represents a fixing unit, reference numeral 8 represents a sorter, reference numeral 9 represents an original tray, and reference numeral 10 represents a paper discharge tray.

An original s et on the original tray 9 is transported by the automatic original feeder 3 onto the original placing glass plate 2, and illuminated with the illuminating lamp 1. Light reflected from the original is focussed on the drum 6 to form an electrostatic latent image thereon. This electrostatic latent image is visualized by the developing unit 4 by using toner. The toner image is transferred by the transfer/separation charger 5 to a recording sheet and heated and fixed by the fixing unit. The recording sheet is then ejected to the paper discharge tray 10 in the sorter 8.

The automatic original feeder 3 has a sensor (not shown) for detecting a presence/absence of an original in the original tray 9. After an original in the original tray 9 is transported to the original placing glass plate 2, if the sensor detects an absence of original, it can be known that there is only one original. After the second original is transported to the original placing glass plate 2, if the sensor detects an absence of original, it can be known that there are two originals.

Figure 2:
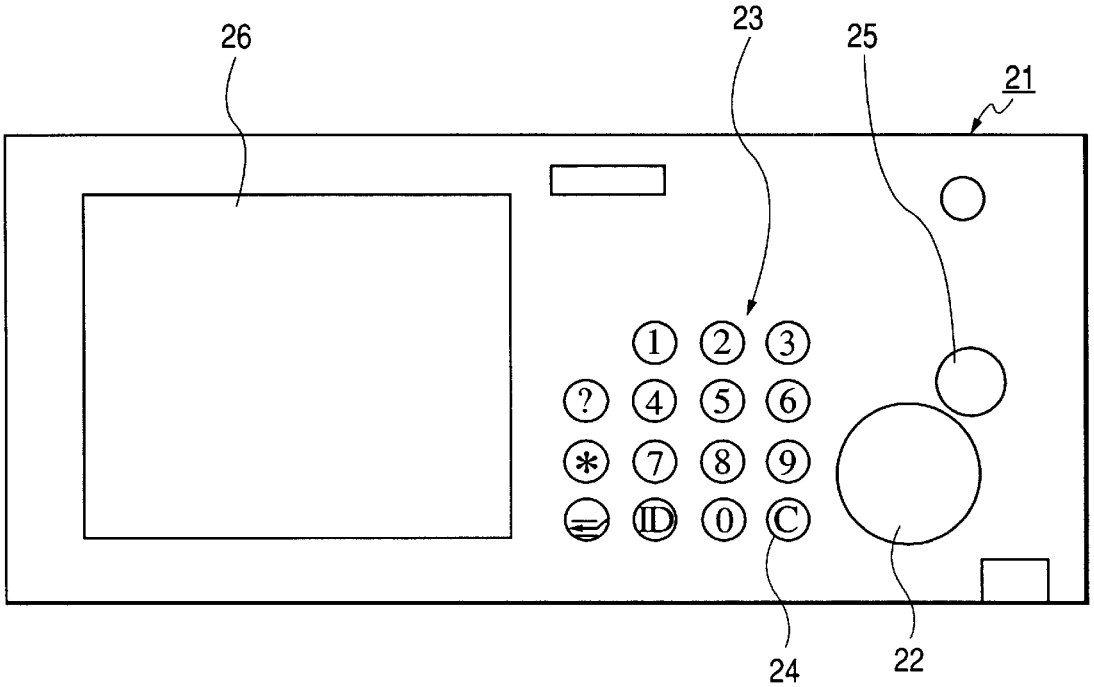
FIG. 2 is a diagram showing a console unit of the image forming apparatus shown in FIG. 1.

FIG. 2 is a schematic diagram showing a console panel of the image forming apparatus shown in FIG. 1. In FIG. 2, reference numeral 21 represents a main body of the console unit, reference numeral 22 represents a start key for instructing to start the image forming operation, and reference numeral 23 represents a ten-key for setting the number of copies to be formed. A value "1" set with this ten-key indicates one image forming operation or two image forming operations depending upon a set image forming mode. Reference numeral 24 represents a clear key for clearing the value set with the ten-key 23, reference numeral 25 represents a stop key for storing the image forming operation, and reference numeral 26 represents a known transparent touch panel and display device used for setting an image forming mode, a paper size, or a magnification, and for displaying a time distance and a value set with the ten-key 23.

Figure 3:
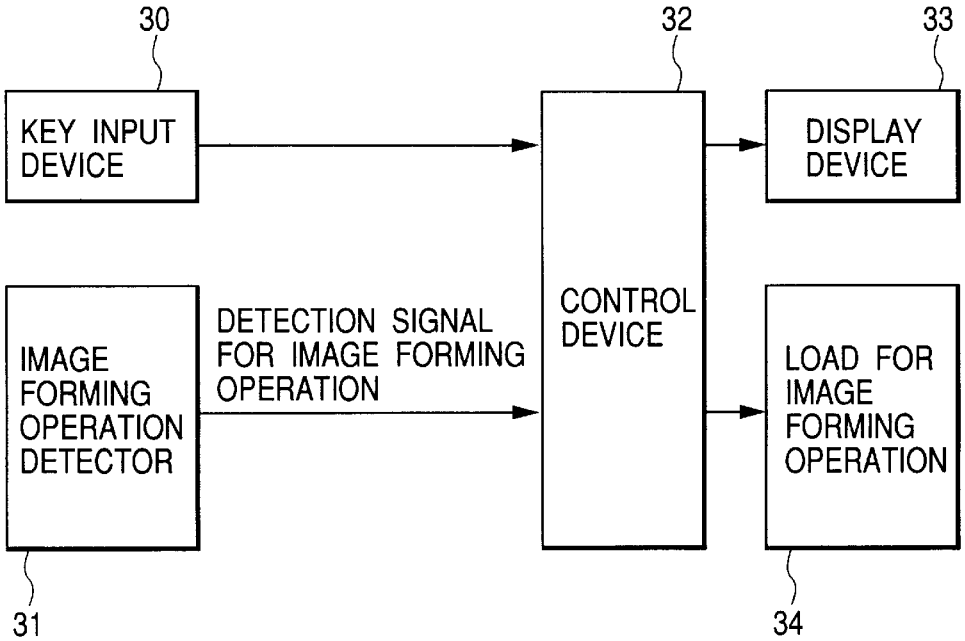
FIG. 3 is a block diagram showing the electric circuit structure of the image forming apparatus shown in FIG. 1.

FIG. 3 is a schematic block diagram showing the electric circuit of the image forming apparatus shown in FIG. 1. In FIG. 3, reference numeral 30 represents a key input device including the components 22 to 26 of the console device shown in FIG. 2. An output of the key input device 30 is supplied to a control device which is constituted of a microcomputer, a storage device and the like. Reference numeral 31 represents an image forming operation detector for generating an image forming operation detecting signal to output an original size detecting signal, a paper detecting signal and the like from unrepresented detectors. These detecting signals are supplied to the control device 32. Reference numeral 33 represents a display device including the display device (refer to FIG. 2) to which a display drive signal is supplied from the control device 32. Reference numeral 34 represents a load for image forming operation, the load including the original illuminating lamp 1, motors (not shown) for driving the development unit 4, transfer/separation charger 5, photosensitive drum 6, fixing unit 7 and the like, control electromagnetic clutches (not shown), heaters (not shown) and the like. Each load is controlled by the control device 32.

Next, the structure of learning data and a learning data producing method according to the embodiment of the invention will be described.

Learning data is constituted of "attribute data" and "time data". The "attribute data" represents the contents of an image forming mode set when an image forming operation starts, the contents being constituted of the following data (1) to (4).

(1) Coded data of an operation mode such as a one-side copy, a both-side copy, a continuous page copy and the like. In this embodiment, the one-side copy is represented by "1", the both-side copy is represented by "2", and the continuous page copy is represented by "3".

(2) Coded data of an original size such as an A4 size, an A3 size, a LTR (letter) size and the like. In this embodiment, the A4 size is represented by "1", the A3 size is represented by "2", and the LTR size is represented by "3".

(3) Coded data of a paper size of a recording sheet (transfer sheet) on which an image is formed, such as an A4 size, an A3 size, a LTR size and the like. In this embodiment, the A4 size is represented by "1", the A3 size is represented by "2", and the LTR size is represented by "3".

(4) Numerical data of a copy magnification factor. In this embodiment, a magnification by 50% is represented by "50", a magnification by 100% is represented by "100", a magnification by 125% is represented by "125", and a magnification by 150% is represented by "150".

The "attribute data" is constituted of a combination of the data (1) to (4). For example, assuming that the image forming mode is set to the one-side copy mode, the original size is set to A4, the paper size is set to A4, and the copy magnification factor is set to 100%, then the "attribute data" is constituted of "1", "1", "1", and "100". Each attribute data is converted into a hexadecimal value and synthesized in the order from (1) to (4) to obtain "01, 01, 01, 64" (hexadecimal notation).

Similarly, assuming that the image forming mode is set to the continuous page copy mode, the original size is set to A3, the paper size is set to LTR, and the copy magnification factor is set to 125%, then "03, 02, 03, 7D" is obtained.

The "time data" in the learning data is constituted of a plurality of following data sets (5) to (7). These data sets each represent a scan interval between the scanning start (scanning start for reading an original) and the next scanning start. The scan interval is represented in the unit of millisecond.

(5) A scan interval measured when an original is not exchanged during the one-side copy mode (i.e., an original is not transported because the number of copies is two or more), measured when an original to be copied on the first side of a recording sheet is scanned during the both-side copy mode, or measured when a first page original is scanned (the number of copies is two or more) during the continuous page copy mode.

(6) A scan interval measured when an original is exchanged by the automatic original feeder 3 during the period from the scan start to the next scan start (the number of originals is two or more).

(7) A scan interval measured when an original to be copied on the other side of a recording sheet is scanned during the both-side scan mode (the number of copies is two or more), or measured when a second original is scanned during the continuous page scan mode (the number of copies is two or more). In the one-side copy mode, the scan interval is unnecessary.

Each of the data sets (5) to (7) is sequentially synthesized for generating the "time data". For example, assuming that the image forming mode is set to the one-side copy mode, the original size is set to A4, the paper size is set to A4, and the copy magnification factor is set to 100%, then the data set (5) of the image forming apparatus of this embodiment is 1200 ms (actually measured value) and so given a value 1200, the data set (6) is 3000 ms (actually measured value) and so given a value 3000, and the data set (7) has no data because the operation mode is the one-side copy mode. Therefore, the "time data" is constituted of "1200" and "3000". The final synthesized values converted into hexadecimal values are therefore "04B0, 0BB8".

Similarly, assuming that the image forming mode is set to the continuous page copy mode, the original size is set to A3, the paper size is set to LTR, and the copy magnification factor is set to 125%, then the data set (5) is 1200 ms and so given a value 1200, the data set (6) is 3000 ms and so given a value 3000, and the data set (7) is 2600 ms and so given a value 2600. Therefore, the time data is constituted of "1200", "3000" and "2600". The final synthesized values converted into hexadecimal values are therefore "04B0, 0BB8, 0A28".

If the measurement conditions of the data sets (5) to (7) are not satisfied, for example, when the number of originals is one, the data "0" is generated. If all the data sets (5) to (7) are 0, then the learning data becomes invalid and are not stored.

Since the "attribute data" and "time data" are generated in the above manner, the learning data for the above example with the image forming mode of the one-side copy mode, the original size of A4, a paper size of A4, and the magnification factor of 100% is given by "01010164, 04B0, 0BB8", whereas the learning data for the above example with the image forming mode of the continuous page copy mode, the original size of A3, a paper size of LTR, and the magnification factor of 125% is given by "0302037D, 04B0, 0BB8, 0A28".

FIG. 4 is a flow chart illustrating timings when a time distance to be described later is calculated and the display process of the image forming apparatus constructed as above.

First, at Step 100 an image forming mode such as a one-side copy mode and a both-side copy mode, a magnification factor and a paper size set with the touch panel and display device 26 are detected.

Next, at Step 101 the number of image copies set with the ten-key 23 is detected.

Next, at Step 102 the operation stands by until the start key 22 is depressed. After the depression of the start key 22, image forming and scan interval measuring are performed in parallel with the following operations until Step 112.

At Step 103, it is judged whether an original is set on the original tray 9 and whether an original is not set on the original placing glass plate 2. If this judgement is affirmative, the flow advances to Step 104, whereas if an original is not set on the original tray and an original is set on the original placing glass plate 2, the flow advances to Step 105.

At Step 105 a variable indicating the number of originals is set to "1" to follow Step 108.

At Step 104 the operation stands by until a first original is transported onto the original placing glass plate 3 by the original feeder 3.

If it is detected at Step 106 by the original feeder 3 that the number of original is "1", the flow advances to Step 108, whereas if it is detected that the number of originals is not "1", an original number input screen for entering the original number with the ten-key 23 is displayed on the display device 26 to thereafter follow Step 107. Whether the number of originals is "1" or not is judged based upon whether it is detected that there is the next original in the tray 9 after the first original is transported.

At Step 107, it is judged whether the number of originals was entered with the ten-key 23. If entered, the flow advances to Step 108, whereas if not, the flow advances to Step 107.

At Step 108, a time distance is calculated by a time distance calculation method to be described later. The calculated time distance is represented by Ts second. In this case, if there is any predictable error, this error is corrected.

In this embodiment, the time distance is represented in the unit of minute. Therefore, at Step 109, the time distance calculated at Step 108 is converted from "second" to "minute". The converted time distance Tm is given by the following equation (1).

$$Tm=Ts/60 \quad (1)$$

At Step 110, Tm is compared with "1" which is a minimum time distance to be displayed on the display device (refer to FIG. 3). If shorter than "1", Tm is set at Step 111 to the minimum time distance "1" to be displayed on the display device 26 to thereafter follow Step 112. If Tm is longer than "1", the flow advances to Step 112.

At Step 112, the calculated or set time distance at Steps 108 and 111 is displayed on the display device 26. If the time distance is 3 minutes, a character string "take 3 minutes to end" is displayed on the display device 26. The decimal part of the calculation result by the equation (1) is half-adjusted.

If the operation is not finished at Step 113, the flow returns to Step 108, whereas if finished, the flow advances to Step 114.

A service man performs an image forming operation for maintenance, adjustment or the like in a service mode which a general user does not use. In this case, an operation different from an image forming operation a general user does not use may be performed, and the time required for such an operation becomes an unusual time.

Even if a general user performs an image forming operation, an abnormal image forming operation is performed when paper jam occurs. Also in this case, the time required for such an operation becomes an unusual time.

Similarly, an abnormal image forming operation is performed if the apparatus is defective (abnormal). Also in this case, the time required for such an operation becomes an unusual time.

If the actual time distance data obtained in such unusual image forming operations is used for data correction (data learning) to be later described, an erroneous time distance is predicted and displayed at the later image forming operation.

In order to avoid such cases, if it is detected at Step 114 that the apparatus is in the service mode for a service man to perform maintenance, check or the like, the measured data is not stored and the flow advances to Step 116. For example, a service mode switch is used to enter the service mode. A depression of the service mode switch is detected when a signal is inputted from this switch to the microcomputer. If it is detected at Step 114 that the apparatus is not in the service mode, the flow advances to Step 115. The judgement at Step 114 of whether the apparatus is in the service mode may be performed immediately after the start key 102 is depressed, and if in the service mode, the processes at Step 103 and following Steps are not performed.

At Step 115, learning data is generated from the measured data by the learning data generating method described earlier, and stored in a memory of the control device 32. In this case, if the memory has the same attribute data as the newly generated attribute data, the time data corresponding to the attribute data in the memory is replaced by the newly generated time data. If the memory has not the same attribute data as the newly generated attribute data and if there is no empty space of the memory storing the learning data, the oldest learning data in the memory is deleted and the newly generated learning data is stored in the new space.

At Step 116, the time distance displayed on the display device 26 is erased.

Next, the time distance calculation method at Step 108 will be described.

Figure 5:
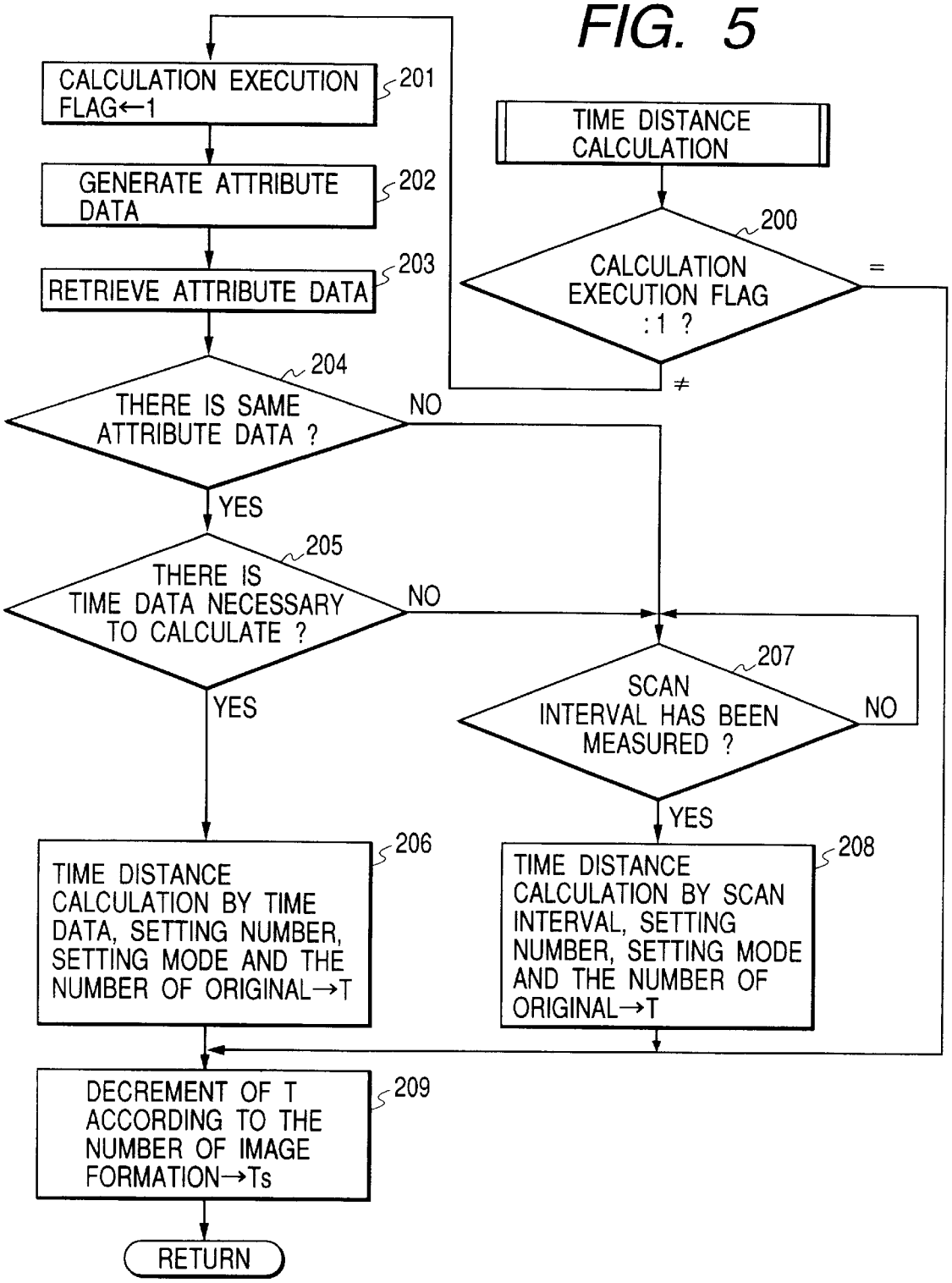
FIG. 5 is a flow chart illustrating the details of time distance calculation.

FIG. 5 is a flow chart illustrating the details of Step 108 shown in FIG. 4.

At Step 200 in FIG. 5, a calculation execution flag is checked, this flag indicating whether the time distance was performed after the image forming operation. If this flag is "1", the flow advances to Step 209, whereas if not, the flow advances to Step 201. This flag is stored in the memory of the control device 32.

At Step 201, "1" is set to the calculation execution flag. At Step 202, attribute data is generated by the learning data generating method described earlier. At Step 203, it is checked whether the memory has the same attribute data generated at Step 202.

At Step 204, if the memory has the same attribute data generated at Step 202, the flow advances to Step 205, whereas if not, the flow advances to Step 207. At Step 205, it is checked whether there is time data necessary for the time distance calculation. This check is performed because there is the case that the stored time data is "0" if the set number of copies does not satisfy the measurement conditions. For example, in calculating the time distance in the one-side copy mode, if the number of originals is 1 and the number of copies is 5, the original is not exchanged by the original feeder 3 so that the data set (6) described in the time data generating method is not necessary and only the data set (5) is necessary. In calculating the time distance in the both-side copy mode, if the number of originals is 5 and the number of copies is 5, all the data sets (5) to (7) are necessary. If there are all the time data necessary for the time distance calculation, the flow advances to Step 206, whereas if not, the flow advances to Step 207.

At Step 206, a time distance is calculated in accordance with the time data, setting numbers, setting mode and the number of originals. The time distance T is given by the following equation (2), where t1, t2 and t3 are the time data sets (5), (6) and (7) and n1, n2, n3 are the numbers of scans to be performed from the start to end of image forming operation. Since the time data is represented in the unit of millisecond, it is converted into the unit of second in the equation (2).

$$T=(t1\times n1+t2\times n2+t3\times n3)/1000 \quad (2)$$

At Step 207, if the scan interval between the first and second scans of image forming operation was measured, the flow advances to Step 208.

At Step 208, a time distance is calculated in accordance with the scan interval, setting numbers, setting mode and the number of originals. This calculation is performed by multiplying the scan interval by the number of scans to be performed from the start to end of image forming operation. The time distance T is given by the following equation (3), where ts is the scan interval and n is the number of scans to be performed from the start to end of image forming operation. Since the scan interval is represented in the unit of millisecond, it is converted into the unit of second in the equation (3).

$$T=ts\times n/1000 \quad (3)$$

In the continuous page copy mode, the scan intervals are different for the first and second originals so that the calculation by the equation (3) has an error. This error is corrected in this embodiment by multiplying T by a coefficient 1.5.

At Step 209, the calculated time distance T is decremented in accordance with the progress degree of image forming operation, i.e., with the number of copies already formed. Specifically, the number of scans to be performed from the start to end of image forming operation is first calculated and then the time distance T is decremented in accordance with the number of scans already performed. In this case, the decremented time distance Ts is given by the following equation (4), where n1 is the number of scans to the performed from the start to end of image forming operation and n2 is the number of scans already performed after the start of image forming operation.

$$Ts=T\times(n1-n2)/n1 \quad (4)$$

In a sheet insertion mode in which a color sheet or the like is inserted between image copies, instead of the scan interval measurement, a transfer sheet feed interval is measured.

FIG. 6 is a flow chart illustrating timings when a time distance is calculated and the display process of the image forming apparatus when a paper jam occurs.

In the flow chart of FIG. 6, the judgement at Step 114 of the flow chart shown in FIG. 4 is replaced by a judgement of whether a paper jam occurs.

Steps 100 to 113 and Steps 115 and 116 are the same as those shown in FIG. 4, and so the description thereof is omitted.

At Step 614, it is judged whether a paper jam occurs during the image forming operation. If there is a jam, the measured data is not stored in the memory and the flow jumps to Step 116.

Even during a usual image forming operation designated by a user, a correct image forming operation cannot be performed if a paper jam occurs. The measured time distance becomes different from that during the normal image forming operation. Therefore, this measured data is not stored in the memory.

FIG. 7 is a flow chart illustrating timings when a time distance is calculated and the display process of the image forming apparatus when the apparatus becomes defective (abnormal).

In the flow chart of FIG. 7, the judgement at Step 114 of the flow chart shown in FIG. 4 is replaced by a judgement of whether the apparatus is defective (abnormal).

Steps 100 to 113 and Steps 115 and 116 are the same as those shown in FIG. 4, and so the description thereof is omitted.

At Step 714, it is judged whether the apparatus becomes defective (abnormal) during the image forming operation. If defective, the measured data is not stored in the memory and the flow jumps to Step 116.

Even during a usual image forming operation designated by a user, a correct image forming operation cannot be performed if the apparatus becomes defective (abnormal). The measured time distance becomes different from that during the normal image forming operation. Therefore, this measured data is not stored in the memory.

The invention is also applicable to an apparatus which uses a removable recording medium storing programs providing the functions described with the above flow charts.

The invention is not limited only to the above embodiments, but various modifications are possible without departing from the scope of the appended claims.

What is claimed is:

1. A time distance notifying apparatus for an image forming apparatus, comprising:

setting means for setting an image forming mode composed of one or plural image forming parameters;

attribute data generating means for generating attribute data to discriminate the image forming mode set by said setting means;

a memory for storing time data representing a time required for forming an image in the image forming mode represented by the various attribute data;

measuring means for measuring a time required for performing an operation of a predetermined unit during the image forming mode set by said setting means;

judging means for judging whether or not the time data corresponding to the attribute data generated by said attribute data generating means has been stored in said memory;

deriving means for deriving a time required for the image forming on the basis of a corresponding time data in a case where it is judged that the time data corresponding to the attribute data has been stored in said memory, and for deriving the time required for the image forming on the basis of the time measured by said measuring means in a case where it is judged that the time data corresponding to the attribute data is not stored in said memory; and notifying means for notifying the time derived by said deriving means.

2. A time distance notifying apparatus according to claim 1, further comprising storage control means for performing a storage control of the time measured by said measuring means into said memory in the case where it is judged that the time data corresponding to the attribute data is not stored in said memory.

3. A time distance notifying apparatus according to claim 2, wherein said storage control means causes to store the time measured by said measuring means in said memory, in correspondence with the attribute data.

4. A time distance notifying apparatus according to claim 1, wherein said measuring means measures a scan interval between originals whose images are formed.

5. A time distance notifying apparatus according to claim 1, wherein said measuring means measures a feed interval between recording sheets on which images are formed.

6. A time distance notifying apparatus according to claim 1, wherein in storing the time measured by said measuring means in said memory, said storage control means deletes the oldest time data stored in said memory if said memory has no empty space.

7. A time distance notifying apparatus according to claim 2, further comprising abnormality detecting means for detecting an abnormality of the image forming apparatus, wherein said storage control means inhibits the measured time to be stored in said memory if said abnormality detecting means detects an abnormality.

8. A time distance notifying apparatus according to claim 2, further comprising means for setting the image forming apparatus to a maintenance mode, wherein said storage control means inhibits the measured time to be stored in said memory during the maintenance mode.

9. A time distance notifying apparatus for an image forming apparatus, comprising:

setting means for setting an image forming mode;

a memory prestoring predetermined time data corresponding to each of various image forming modes;

measuring means for measuring a time required to finish an image forming operation in an operation of a predetermined unit after the image forming operation starts in accordance with the image forming mode set by said setting means;

first deriving means for deriving a time required to finish an image forming operation, in accordance with the image forming mode set by said setting means and the predetermined time data stored in said memory;

second deriving means for deriving a time required to finish an image forming operation, in accordance with the image forming mode set by said setting means and the time measured by said measuring means; and selecting means for selectively operating either said first or second deriving means on the basis of comparison between the image forming mode set by said setting means and the image forming mode corresponding to the time data prestored in said memory.

10. A time distance notifying apparatus according to claim 9, wherein said measuring means measures a scan interval between originals whose images are formed.

11. A time distance notifying apparatus according to claim 9, wherein said measuring means measures a feed interval between recording sheets on which images are formed.

12. A time distance notifying method for an image forming apparatus having a memory for storing time data representing a time required for forming an image in various image forming modes, said method comprising the steps of:

(a) setting the desired image forming mode composed of one or plural image forming parameters;

(b) generating attribute data to discriminate the image forming mode set at said setting step;

(c) measuring a time required for performing an operation of a predetermined unit during an image forming operation;

(d) judging whether or not the time data corresponding to the attribute data generated at said generating step has been stored in the memory;

(e) deriving the time required for the image forming on the basis of the corresponding time data in a case where it is judged at said judging step that the time data corresponding to the attribute data has been stored in the memory, and deriving the time required for the image forming on the basis of the time measured at said measuring step in a case where it is judged that the time data corresponding to the attribute data is not stored in the memory; and (f) notifying ta time derived at said deriving step.

13. A time distance notifying method according to claim 12, further comprising the step of:

(g) storing the time measured at said measuring step in the memory in the case where it is judged at said step (d) that the time data corresponding to the attribute data is not stored in the memory.

14. A time distance notifying method according to claim 13, wherein said storing step stores the measured time in the memory, in correspondence with the attribute data.

15. A time distance notifying method according to claim 12, wherein said measuring step measures a scan interval between originals whose images are formed.

16. A time distance notifying method according to claim 12, wherein said measuring step measures a feed interval between recording sheets on which images are formed.

17. A time distance notifying method according to claim 12, said storing step deletes the oldest time data stored in the memory if the memory has no empty space.

18. A time distance notifying method according to claim 13, further comprising the step of:

(i) setting the image forming apparatus to a maintenance mode, wherein said storing step inhibits the measured time to be stored in the memory during the maintenance mode.

19. A time distance notifying method according to claim 13, further comprising the step of:

(g) setting the image forming apparatus to a maintenance mode, wherein said step (e) inhibits the measured time to be stored in the memory during the maintenance mode.

20. A time distance notifying method for an image forming apparatus having a memory prestoring predetermined time data corresponding to each of various image forming modes, the method comprising the steps of:

(a) setting a desired image forming mode;

(b) measuring a time required to finish an image forming operation in an operation of a predetermined unit after the image forming operation starts in accordance with the image forming mode set at said setting step;

(c) deriving a time required to finish an image forming operation, in accordance with the image forming mode set at said setting step and the predetermined time data stored in said memory;

(d) deriving a time required to finish an image forming operation, in accordance with the image forming mode set at said setting step and the time measured at said measuring step;

(e) selectively operating either said step (c) or said step (d) on the basis of a comparison between the image forming mode set at said setting step and the image forming mode corresponding to the time data prestored in the memory.

21. A time distance notifying method according to claim 20, wherein said step (b) measures a scan interval between originals whose images are formed.

22. A time distance notifying method according to claim 20, wherein said step (b) measures a feed interval between recording sheets on which images are formed.

23. A time distance notifying apparatus for an image forming apparatus, comprising:

setting means for setting an image forming mode;

measuring means for measuring a time required to finish an image forming operation in an operation of a predetermined unit after the image forming operation starts in accordance with the image forming mode set by said setting means;

deriving means for deriving a time required to finish an image forming operation, in accordance with the image forming mode set by said setting means and the time measured by said measuring means;

notifying means for notifying the time derived by said deriving means; and storage controlling means for causing a memory to store time data as correlating data with the image forming mode set by said setting means, to use the data representing the time derived by said deriving means to derive the time in a next and a following image forming operation.

24. A time distance notifying apparatus according to claim 23, wherein said measuring means measures a scan interval between originals whose images are formed.

25. A time distance notifying apparatus according to claim 23, wherein said measuring means measures a feed interval between recording sheets on which images are formed.

26. A time distance notifying method comprising the steps of:

(a) setting a desired image forming mode;

(b) measuring a time required to finish an image forming operation in an operation of a predetermined unit after the image forming operation starts in accordance with the image forming mode set at said setting step;

(c) deriving a time required to finish an image forming operation, in accordance with the image forming mode set at said setting step and the time measured at said measuring step;

notifying the time derived at said deriving step; and causing a memory to store the time data as correlating the data with the image forming mode set at said setting step, to use the data representing the time derived at said deriving step to derive the time in next and following image forming.

27. A time distance method according to claim 26, wherein said measuring step measures a scan interval between originals whose images are formed.

28. A time distance notifying method according to claim 23, wherein said measuring step measures a feed interval between recording sheets on which images are formed.

* * * * *

UNITED STATES PATENT AND TRADEMARK OFFICE

CERTIFICATE OF CORRECTION

PATENT NO. : 5,960,234

DATED : September 28, 1999

INVENTORS : SEIJI SHIBAKI, et al.

It is certified that error appears in the above-identified patent and that said Letters Patent is hereby corrected as shown below:

Title page item [56],

REFERENCES CITED:

U.S. PATENT DOCUMENTS, "5,809,371 10/1998" should read --5,809,371 9/1998--.

COLUMN 2:

Line 63, "s et" should read --set--.

Signed and Sealed this

Fifteenth Day of August, 2000

Attest:

Q. TODD DICKINSON

Attesting Officer

Director of Patents and Trademarks